US006923275B2

(12) United States Patent
Gardes

(10) Patent No.: US 6,923,275 B2
(45) Date of Patent: Aug. 2, 2005

(54) MULTI SEAM COAL BED/METHANE DEWATERING AND DEPRESSURIZING PRODUCTION SYSTEM

(76) Inventor: Robert Gardes, P.O. Box 92593, Lafayette, LA (US) 70509

( * ) Notice: Subject to any disclaimer, the term of this patent is extended or adjusted under 35 U.S.C. 154(b) by 0 days.

(21) Appl. No.: 10/372,522

(22) Filed: Feb. 21, 2003

(65) Prior Publication Data

US 2003/0221836 A1 Dec. 4, 2003

Related U.S. Application Data

(63) Continuation-in-part of application No. 10/262,557, filed on Sep. 30, 2002, which is a continuation of application No. 09/771,746, filed on Jan. 29, 2001, now Pat. No. 6,457,540.

(60) Provisional application No. 60/384,871, filed on May 31, 2002, and provisional application No. 60/388,696, filed on Jun. 14, 2002.

(51) Int. Cl.[7] ..... E21B 7/04; E21B 43/12

(52) U.S. Cl. ..... 175/61; 175/70; 166/50; 166/117.5

(58) Field of Search ..... 175/61, 62, 70; 166/50, 53, 313, 117.5, 117.6

(56) References Cited

U.S. PATENT DOCUMENTS

| | | | | |
|---|---|---|---|---|
| 5,720,356 A | * | 2/1998 | Gardes | 175/62 |
| 6,065,550 A | | 5/2000 | Gardes | |
| 6,357,523 B1 | | 3/2002 | Zupanick | |
| 6,425,448 B1 | | 7/2002 | Zupanick et al. | |
| 6,457,540 B2 | | 10/2002 | Gardes | |
| 2003/0062198 A1 | * | 4/2003 | Gardes | 175/61 |
| 2004/0007389 A1 | | 1/2004 | Zupanick | |
| 2004/0007390 A1 | | 1/2004 | Zupanick | |
| 2004/0035582 A1 | * | 2/2004 | Zupanick | 166/313 |
| 2004/0060737 A1 | * | 4/2004 | deBoer | 175/7 |

* cited by examiner

*Primary Examiner*—William Neuder
(74) *Attorney, Agent, or Firm*—Garvey, Smith, Nehrbass & Doody, L.L.C.; Gregory C. Smith

(57) ABSTRACT

A process for underbalanced drilling into multiple coal and shale formations, and dewatering the drilled formations, which includes drilling a first borehole through several coal seams to a certain depth, defined as a cased borehole; lowering an upstock on the end of a carrier string to the depth of the upper coal seam; lowering a drill string in the carrier string, and angling off of the upstock, to drill a lateral or horizontal borehole within the coal seam; repeating the process for the second coal seam; setting a packer in place above the first coal seam in the annulus between the cased borehole and the carrier string; forming perforations in the wall of the carrier string below the packer; retrieving the upstock from the carrier string; lowering an electrical submersible pump to the bottom of the principal borehole, defined as a sump portion of the borehole; collecting methane gas from the two coal seams through the annulus between the second drill string and the carrier string to the surface; pumping water from the sump portion to the surface within the annulus of the second drill string, while gas within the annulus between the carrier string and the outer casing enters the plurality of perforations in the carrier string to be carried up to the surface.

15 Claims, 21 Drawing Sheets

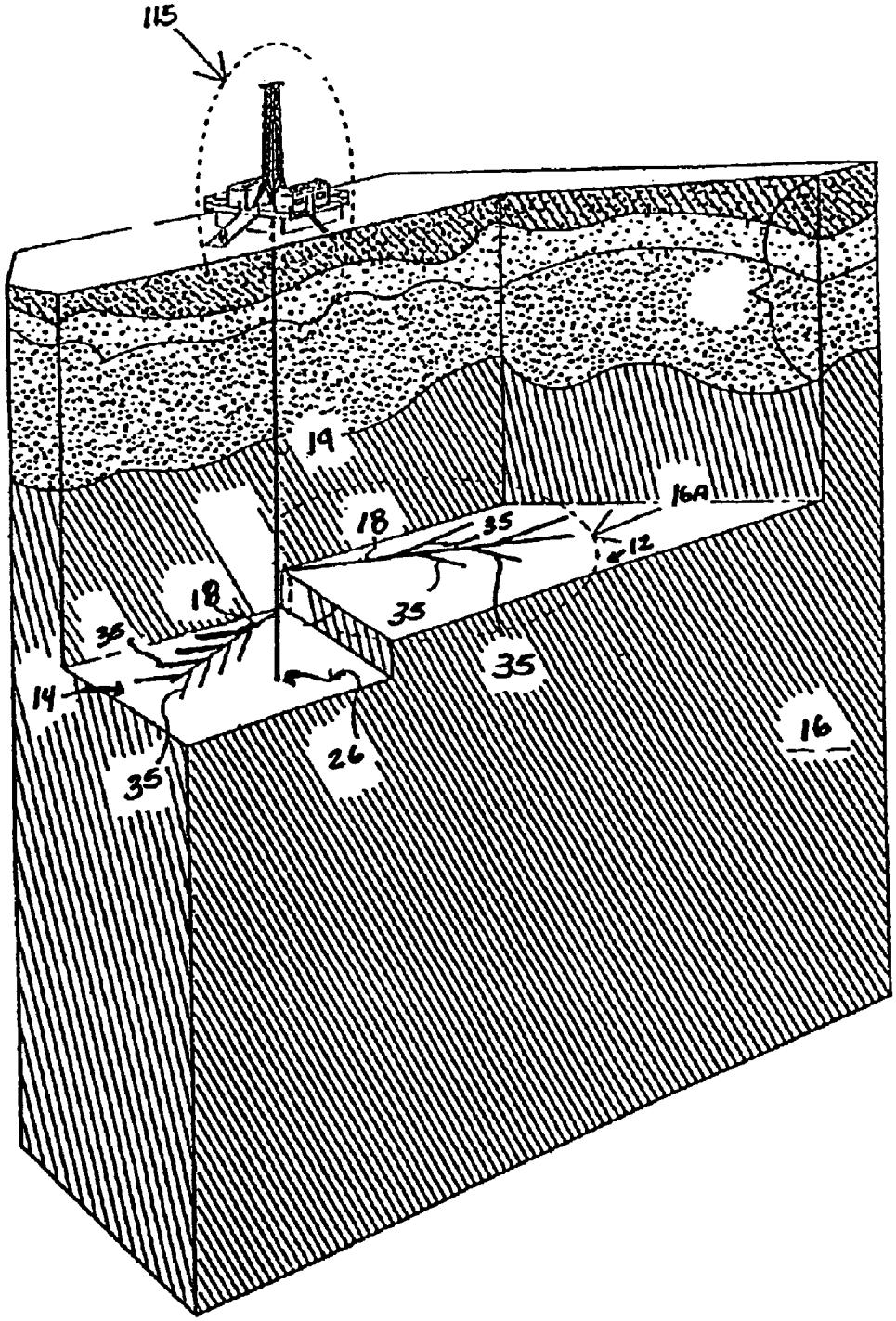
16B

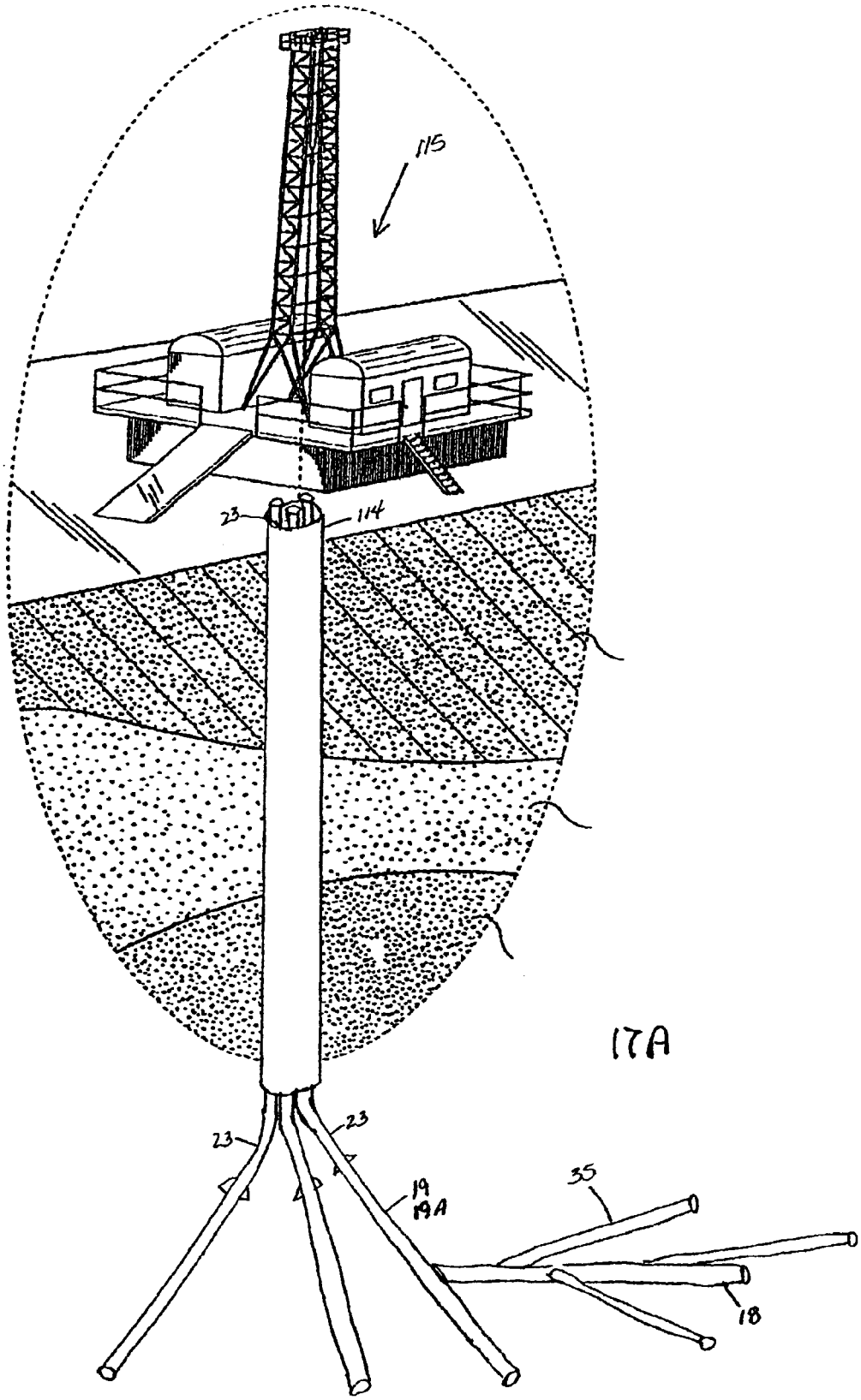
17A

MULTI SEAM COAL BED/METHANE DEWATERING AND DEPRESSURIZING PRODUCTION SYSTEM

CROSS-REFERENCE TO RELATED APPLICATIONS

This application claims priority of provisional patent application entitled "MULTI LENSE COAL BED/METHANE DEWATERING AND PRODUCTION SYSTEM," Ser. No. 60/384,871, filed on May 31, 2002, and provisional patent application entitled "MULTI LENSE COAL BED/METHANE DEWATERING AND PRODUCTION SYSTEM," Ser. No. 60/388,696, filed on Jun. 14, 2002, both by the same inventor, both of which are fully incorporated herein by reference thereto.

This is a continuation-in-part application of co-pending U.S. patent application Ser. No. 10/262,557 filed Sep. 30, 2002, entitled "Method and System for Hydraulic Friction Controlled Drilling and Completing Geopressured Wells Utilizing Concentric Drill Strings", which was a continuation of patent application U.S. Ser. No. 09/771,746, filed Jan. 29, 2001, by the same title, which issued as U.S. Pat. No. 6,457,540, on Oct. 1, 2002, both of which are incorporated herein by reference.

STATEMENT REGARDING FEDERALLY SPONSORED RESEARCH OR DEVELOPMENT

Not applicable

REFERENCE TO A "MICROFICHE APPENDIX"

Not applicable

BACKGROUND OF THE INVENTION

1. Field of the Invention

The present invention relates to a system and method for dewatering and producing gas from coalbed and shale seams utilizing underbalanced multilateral drilling techniques.

2. General Background of the Invention

In the drilling of wells, one of the most critical elements in drilling has always been to maintain the well in a hydrostatically balanced state, so that should the drill bit strike a pocket of hydrocarbons, that the formation pressure does not overcome the hydrostatic pressure of the drill fluid column in the well, and thus a blow out does not occur. In conventional drilling, what has always been done, is during the drilling process, to flow heavy fluids; i.e., muds, into the drill bore during drilling, so that the hydrostatic pressure of the muds within the borehole is heavier than the pressure from the formation. Therefore, any potential blowout which may occur otherwise is prevented due to the heavy muds which create the higher hydrostatic pressure downward into the formation.

It has been recently found, that when such a hydrostatic head is placed on the formation, often times the heavy muds or fluids flow into the formation, and by doing so, create severe damage of the formation, which is a detriment to the productivity of the formation. Therefore, there has been developed the technique that is called underbalanced drilling, which technique allows for greater production, and does not create formation damage which would impede the production process. Furthermore, it has been shown that productivity is enhanced in multilateral wells combined with the non-formation damaging affects of the underbalanced drilling. These results are accomplished by introducing a lighter fluid such as nitrogen or air into the drill hole, or a combination of same or other type fluids or gases, sufficiently as to create an underbalance so that fluid in the borehole does not move into the formation during drilling. In order to accomplish this, often times the drilling is undertaken through the use of coil tubing, or jointed pipe systems in conjunction with aerated fluids. Another technique of underbalanced drilling is referred to as micro-annulus drilling where a low pressure reservoir is drilled. In effect, a string of casing is lowered into the well bore and utilizing a two string drilling technique, there is circulated a lighter fluid down the outer annulus, which lowers the hydrostatic pressure of the fluid column, thus relieving the formation. This allows the fluid column to be lighter than the formation pressure which, if it weren't, would cause invasion of drilling fluid and solids to enter the formation which is detrimental to productivity. By utilizing this system, drillers are able to circulate a lighter fluid which can return up either inner or outer annulus, which enables them to circulate with a different fluid down the drill string. In doing so, basically air and nitrogen are being introduced down the system which allows them to circulate two different combination fluids with two different strings.

The technology utilized in underbalanced drilling of oil and gas wells can also be applied to the process of de-watering and disposal of produced water when drilling to recover coalbed methane and shale gas. There exists an estimated total more than 700 trillion cubic feet of coalbed methane gas accumulations in the United States and some 7500 trillion cubic feet worldwide. The use of underbalanced drilling techniques is a very efficient, cost effective manner of recovering this huge methane gas resource. The underbalanced techniques heretofore utilized for oil and gas recovery, as disclosed and claimed in U.S. Pat. No. 5,720,350 and No. 6,045,550, both by the same inventor, and incorporated herein by reference thereto.

BRIEF SUMMARY OF THE INVENTION

The method of the present invention relates to a method for production of coalbed methane and shale gas, and a system for dewatering and producing gas from a multi lense coal and shale seams utilizing underbalanced drilling techniques. In the method, a first borehole is drilled through several coal seams to a certain depth, defined as a cased or open hole borehole; the drill string is retrieved and an upstock is lowered on the end of a carrier string to the depth of the upper coal seam; a second drill string is lowered in the carrier string, and deflecting off of the upstock, a lateral or horizontal borehole is drilled within the coal seam. The process is repeated for the second coal seam; a packer is set in place above the first coal seam in the annulus between the cased borehole and the carrier string; a perforating gun is lowered within the carrier string to a depth above the upper coal seam and perforations are formed in the wall of the carrier string; a retrieval tool is lowered to retrieve the upstock from the carrier string; an electrical submersible pump is lowered at the end of a second drill string to the bottom of the principal borehole, defined as a sump portion of the borehole; methane gas is collected from the two coal seams through the annulus between the dewatering tubing string and the carrier string to the surface; water in the coal seams, flows to the sump portion where the ESP pumps the water to the surface within the annulus of the inner tubing string, while gas within the annulus between the carrier string and the outer casing enters the plurality of perforations in the carrier string and is carried up to the surface; under a first option water from the two coal seams is pumped by the ESP through perforations in the wall of the casing, to a first lower water injection zone below the coal seams; in a second option the water can be first delivered to the surface, and then returned down the annulus between the outer casing and carrier string to be injected into a water injection zone above the coal seams. It is foreseen that multiple wells can be drilled, and when the water is returned to the surface, the water would be routed to one of the wells which would return the water to a single water injection zone.

Therefore, it is the principal object of the present invention to provide a system and method for dewatering and producing gas from coalbed and shale seams utilizing underbalanced multilateral drilling techniques in both cased and uncased boreholes;

It is a further object of the present invention to combine multilateral drilling with a system that combines gas production dewatering and disposal all in a single well in order to eliminate the infrastructure long term maintenance and environmental impact associated with vertical well systems;

It is a further object of the present invention to provide higher recovery rates and faster dewatering with the use of multilateral well bores and each coal seam, thereby having high reservoir exposure and ariel sweep as well as the ability to precisely place boreholes within the formation;

It is a further object of the system of the present invention to eliminate formation damage created during the drilling process by utilizing underbalanced drilling, so that the dual injection annulus system reduces the hydrostatic pressure of the damaging drill fluids and invasion into the formation;

It is a further object of the present invention to provide higher recovery rates, faster dewatering minimal infrastructure and broader ariel sweep added to the increased net present value (npv) of the property;

It is a further object of the present invention to provide the underbalanced drilling technique for reaching both shallow coal deposits and those below 5,000 feet, which are estimated to hold over 50% of the gas reserves in many major coal bed producing regions;

It is a further object of the present invention to utilize underbalanced, multilateral drilling in coal bed methane recovery, having minimal environmental impact so that a single well can produce as much gas as eight traditional vertical wells on eighty acre spacing;

It is a further object of the present invention to combine multilateral drilling with a system that combines gas production, dewatering and disposal all in a single well, thus eliminating a large part of the infrastructure, and environmental impact associated with vertical well systems.

BRIEF DESCRIPTION OF THE DRAWINGS

For a further understanding of the nature, objects, and advantages of the present invention, reference should be had to the following detailed description, read in conjunction with the following drawings, wherein like reference numerals denote like elements and wherein:

FIGS. 17–17A illustrate a schematic of multiple wells as seen in FIGS. 16–16B, together in a single caisson.

DETAILED DESCRIPTION OF THE PREFERRED EMBODIMENT

Figure 1:
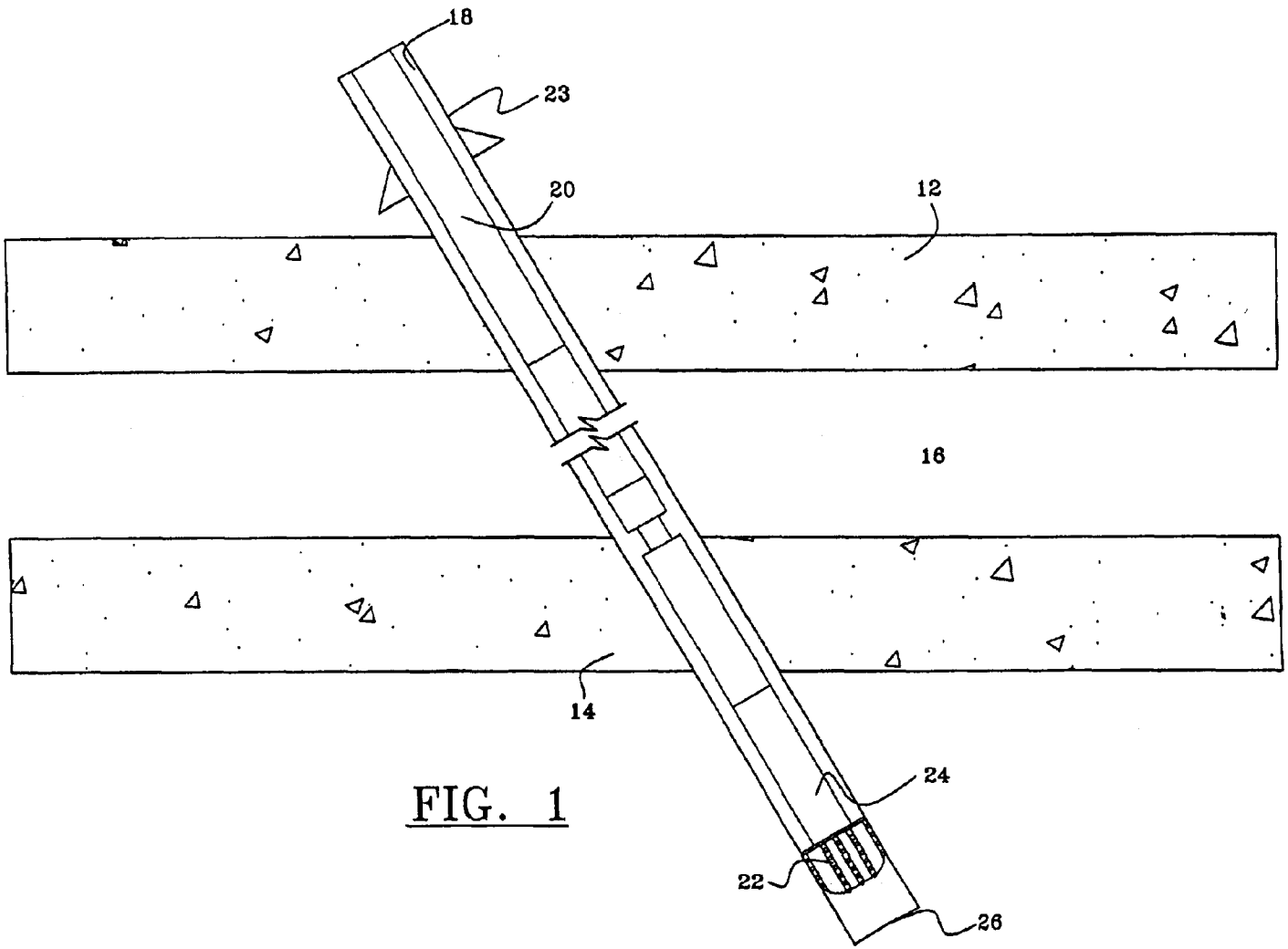
FIG. 1 illustrates drilling a directional hole through productive coal seams.

FIGS. 1–18 illustrate the preferred embodiment of the method of the present invention. As illustrated in FIG. 1, there is seen a first upper coal bed seam 12 and a second lower coal bed seam 14, the upper and lower coal bed seams 12, 14 set within a formation 16, above, between, and below the coal bed seams 12, 14, thousands of feet below the surface of the earth. Although coal seams 12, 14 are illustrated, it is foreseen for purposes of the invention, that there may be multiple coal seams involved in the process. However, for efficiency in explanation, reference will be made to two coal seams, 12, 14.

As illustrated further in FIG. 1, there is illustrated a directional borehole 18, which has been drilled through the first and second coal seams 12, 14. The directional borehole 18 has been drilled with traditional directional drilling techniques. There is further illustrated a drill string 20, having a drill bit 22 at its lower end, driven by a drill motor 24, to a particular depth 26. This borehole 18 is drilled and logged determining the productive interval to be drilled horizontally and multilaterally from the this pilot borehole 18. The borehole 18 may then be cased throughout its length to define a cased borehole 19A.

Figure 2:
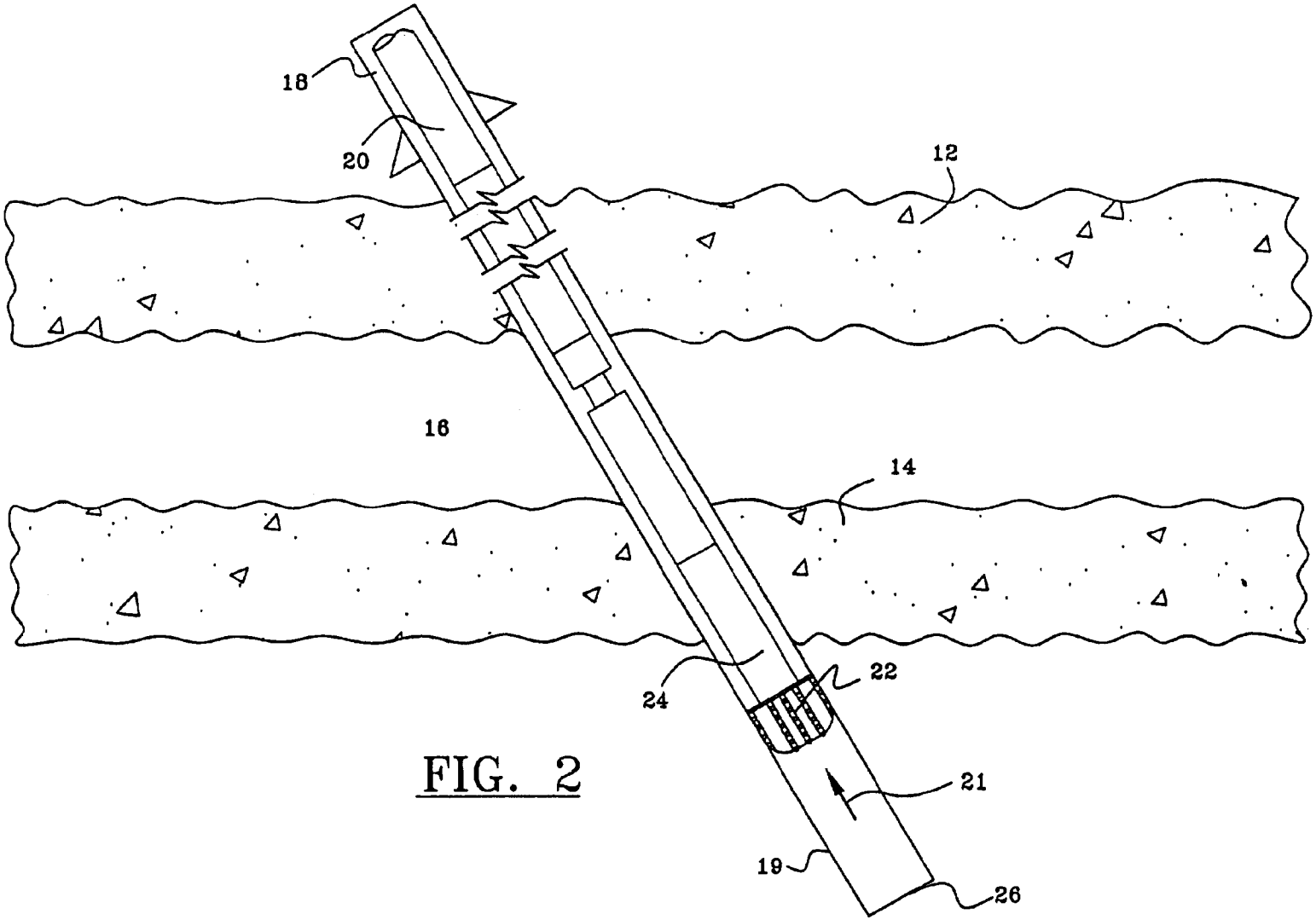
FIG. 2 illustrates pulling out of the directional hole with the drill string.

In FIG. 2 there is illustrated the same borehole 18, with the drill string 20 being retrieved out of the borehole 18 in direction of arrow 21. The drill string 20 would be retrieved completely from the bore 18, leaving an empty open hole borehole, so that further work may take place in the process.

Figure 2A:
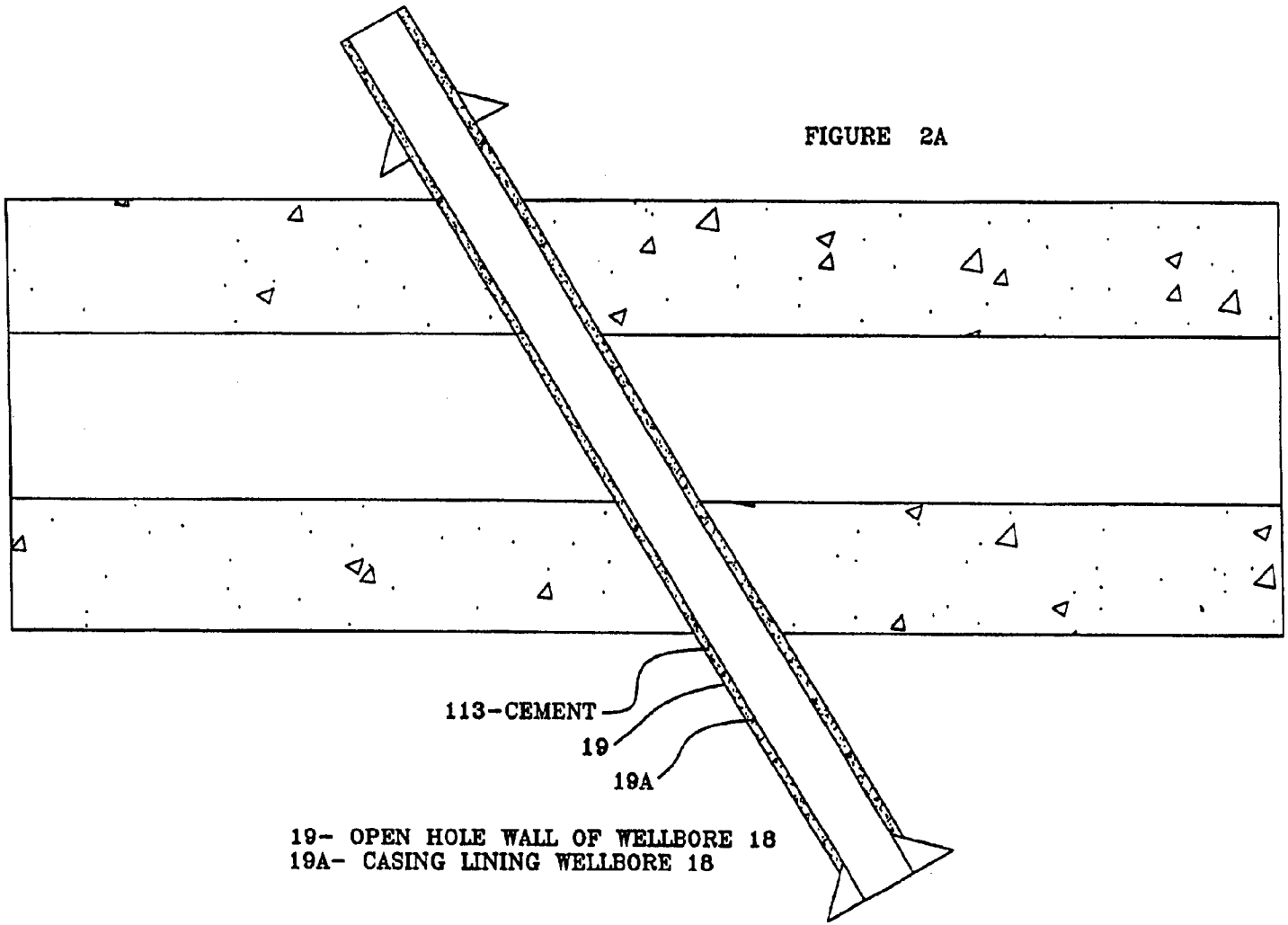
FIG. 2A illustrates a borehole which is lined with casing.

In FIG. 2A, there is illustrated casing 19A run into well bore 18 and cemented in place via cement 113. For purposes of the method and system as disclosed and claimed herein, the method and process may be carried out in the cased well bore 18, as seen in FIG. 2A, as well as an uncased well bore.

Figure 3:
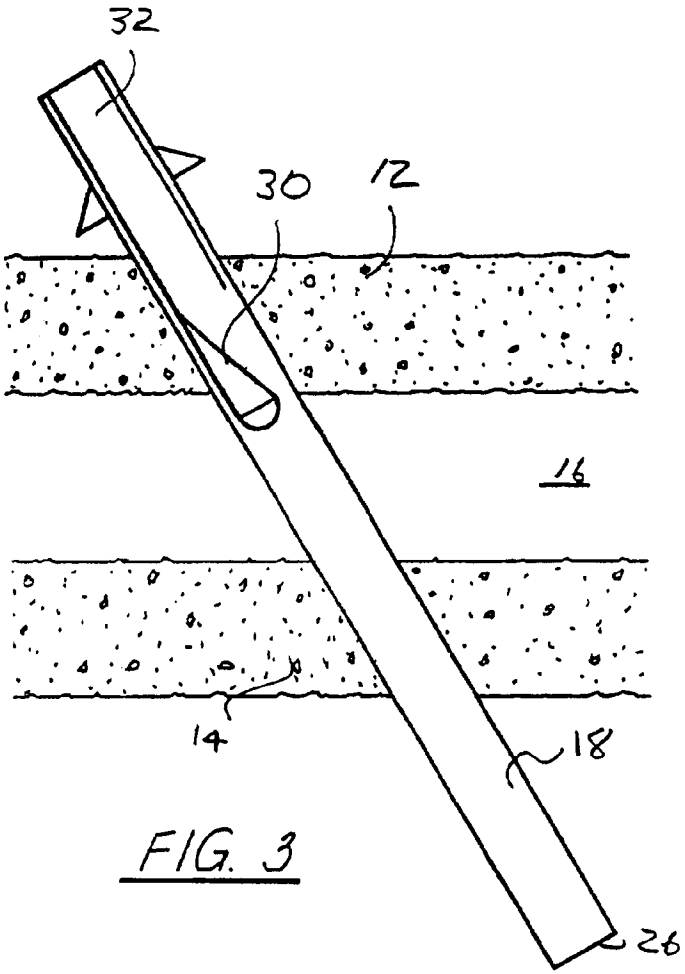
FIG. 3 illustrates picking up the upstock and running it into the hole and orienting same.

Turning now to FIG. 3, there is illustrated an upstock 30, which is known in the art, and which has been run into the borehole 18 at the end of a carrier string 32, and has been properly oriented to commence a directional borehole. As seen in Figure, the upstock 30 would be positioned into the well bore at the first upper coal seam 12, and the carrier string 32 would be positioned and sealed at the wellhead. A review of U.S. Pat. Nos. 5,720,356 and 6,065,550 describe the drilling apparatus and process that would be utilized in the underbalanced drilling of the shale and coal seams 12 and 14.

Turning now to FIG. 4, there again is illustrated the upstock 30, in proper oriented position within the borehole 18, at the upper coal or shale seam 12. As illustrated, there is seen a second directional drill string 34, being lowered into the carrier string 32, via the drill string 34, and oriented in the same direction as the upstock 30. The techniques of drilling a directional or horizontal well off of a principal drill string utilizing an upstock at the end of a carrier string is well known in the art of oil and gas drilling. This orientation can be performed by a number of systems including a gyro, steering tool, mwd, or electromagnetic mwd. As is illustrated, the directional drill string 34, has made contact with the ramp portion 31 of upstock 30, so as to begin drilling through the wall 19 as seen in FIG. 2 or of casing 19A as seen in FIG. 2A within borehole 18.

Figure 5:
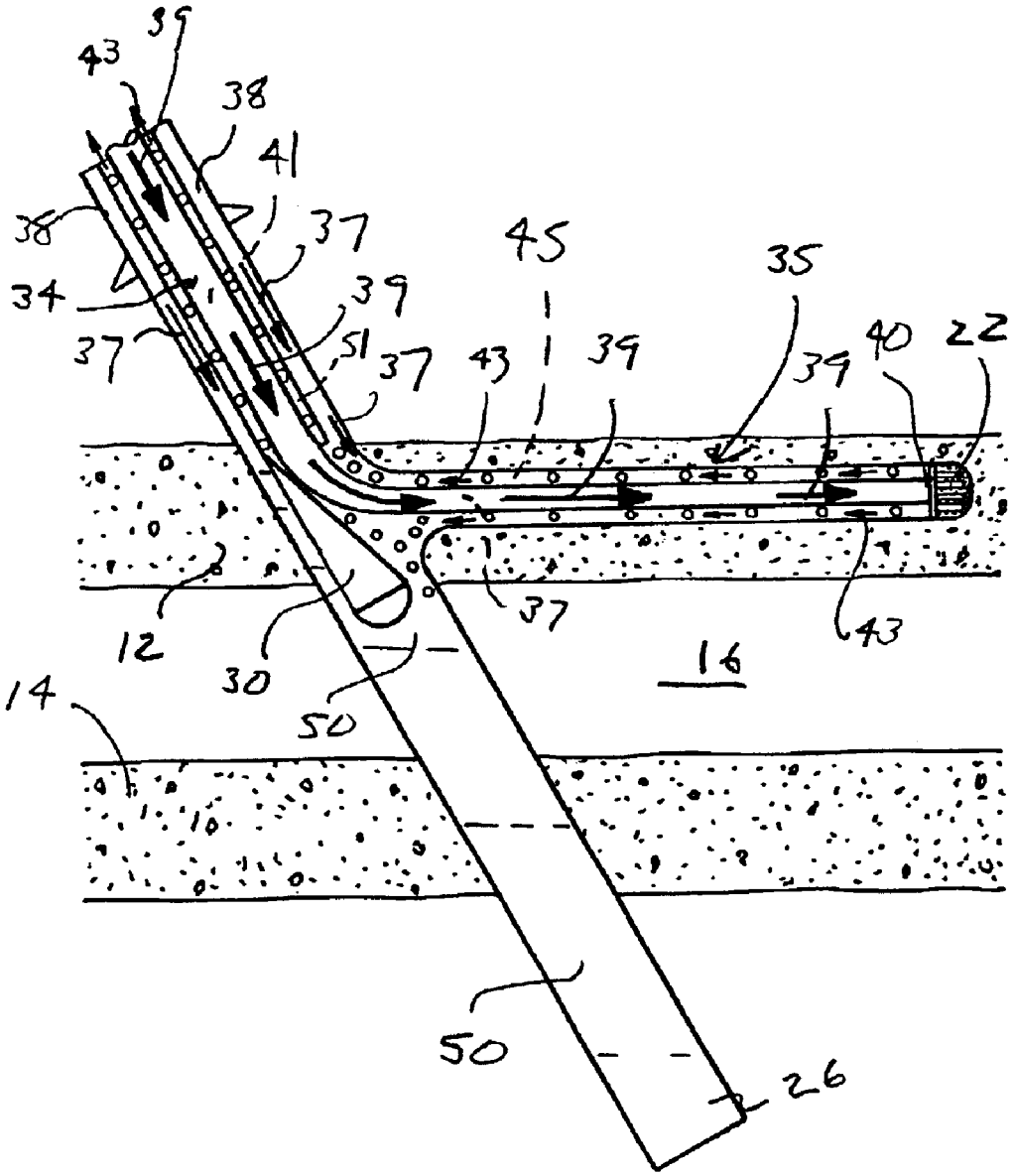
FIG. 5 illustrates drilling a horizontal well in an underbalanced mode.

As illustrated in FIG. 5, the drilling into the upper coal seam 12, has commenced, with the drill bit 22 at the end of the drill string 34, having bored through the wall 19 or of the casing 19A lining the borehole 18, and has begun drilling into the coal or shale seam 12 forming a horizontal or lateral bore 35 within the coal seam 12. At this point, there is illustrated nitrogen gas, air and/or water pumped down the annulus 38 between the wall of the casing 23 and carrier string 32 as depicted by arrow 37. Second, there is illustrated nitrogen gas, air and fluid being pumped down the inner annulus 41 of the drill string 34 depicted by arrow 39 throughout the length of the drill string up to the drill bit 22. During this process, the mud motor 40 is then activated by the fluids, arrow 39, being pumped down the interior annulus 41 of the drill string 34. The system is guided by an mwd or electromagnetic mwd, or steering tool system, of the type known in the art. The drilling process can incorporate short radius or medium radius drilling systems with build rates from 10° per 100 feet to 90° per 30 feet depending on bed thickness and bottom hole pressure. In conjunction and simultaneously with pumping fluid 39 down the drill pipe 34, a combination of air/nitrogen gas/fluid (arrow 37), is being pumped down the outer annulus 38, while nitrogen/air/drilling fluid and gas (arrow 43) is returning within an annulus 45 formed between the drill string 34 and the borehole wall 19 or 19A, in the lateral bore 35. This fluid and gas within annulus 45 will commingle with the nitrogen gas, air and drilling fluid within the annulus 51 formed between the drill string 34, and the wall of the carrier string 32, as illustrated by arrow 43. Upon the combined fluids in the return annulus 51 commingling with the fluid/gas in the annulus 43, the mixture of fluid/gas/air will be returned to the surface to remove the cuttings from the well bore 18. The objective of underbalanced drilling of coal and shale is to have the hydrostatic pressure of the drilling process to be lower than the formation pressure, as to not invade the formation with fines that may plug the fractures or fluid that may interact with the formation causing the swelling of clay particles or phase trapping commonly referred to as formation damage.

Figure 4:
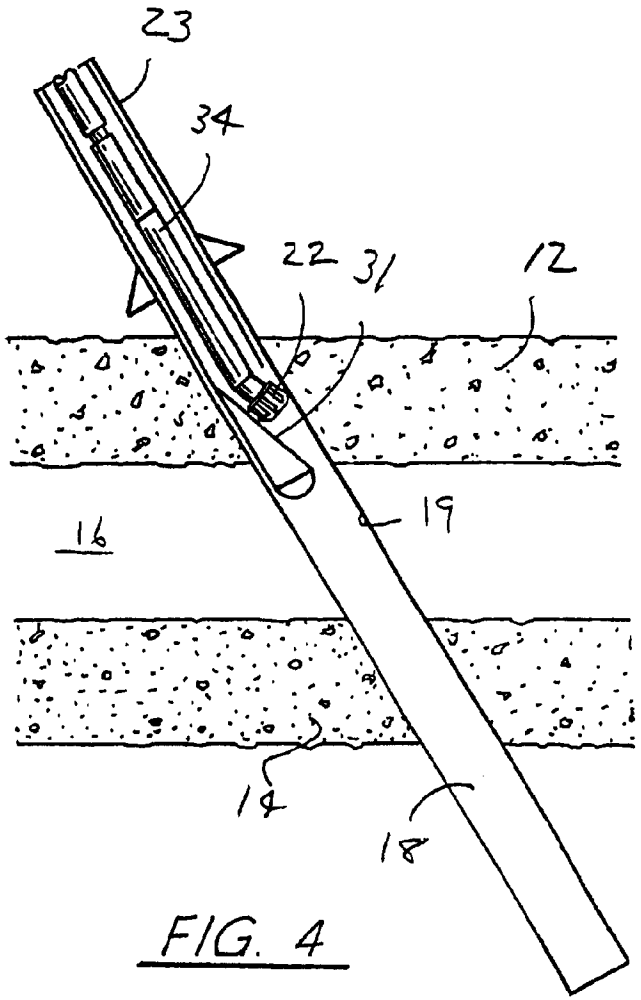
FIG. 4 illustrates running the drill string into the hole and orienting same.
Figure 6:
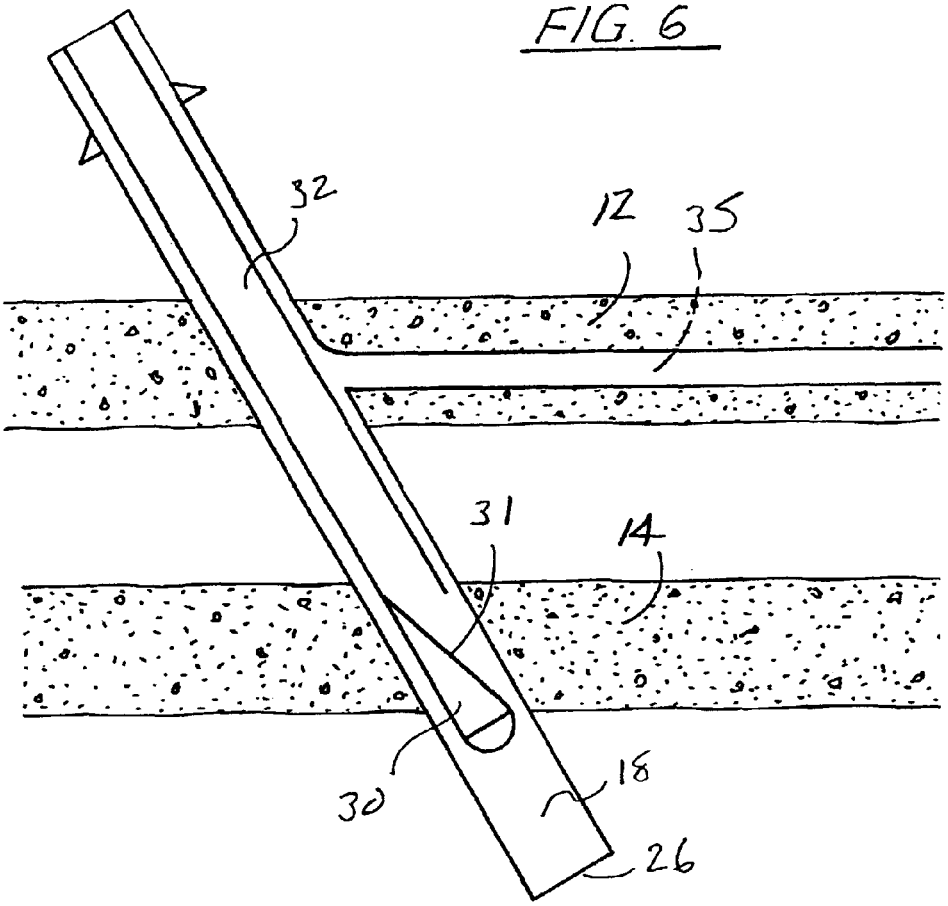
FIG. 6 illustrates lowering the upstock to the next zone and orienting same.
Figure 7:
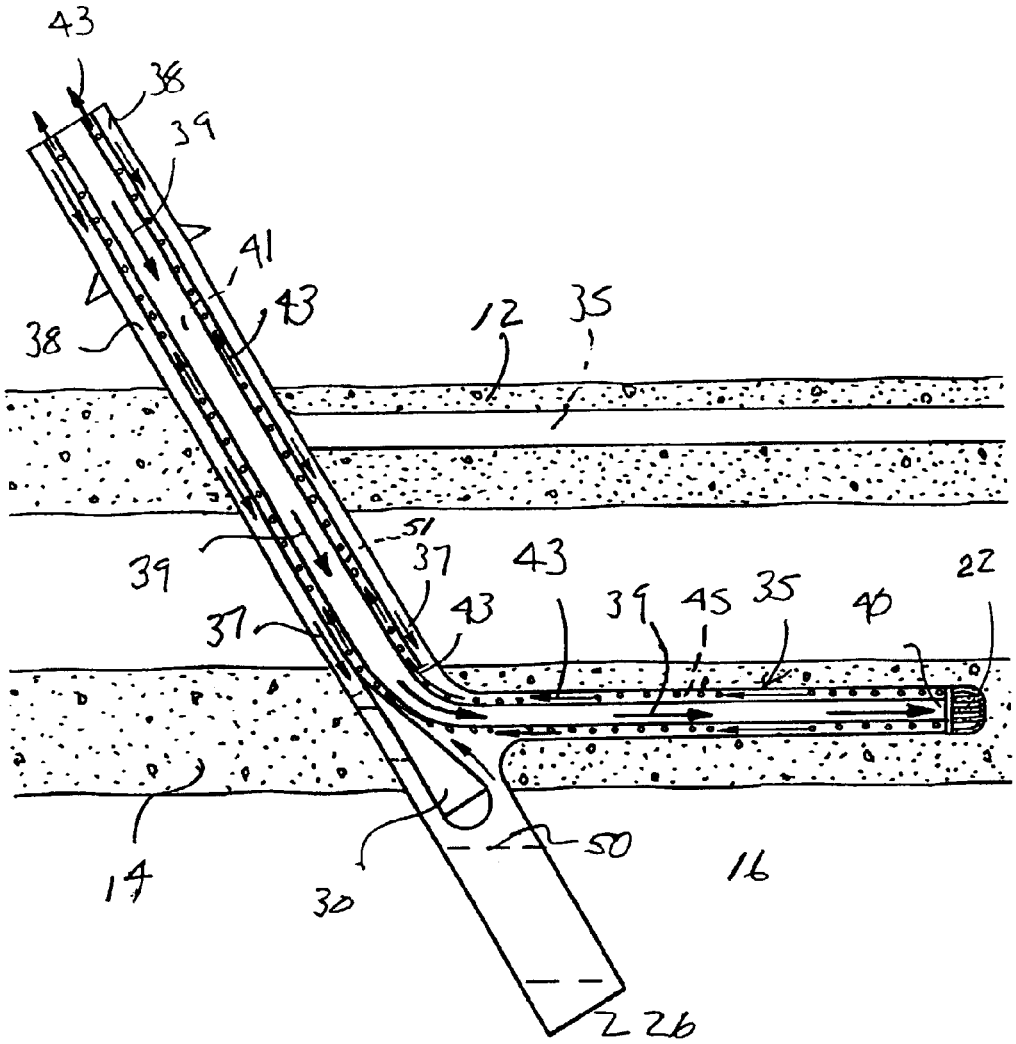
FIG. 7 illustrates drilling a horizontal lateral well at the lower zone.

Turning now to FIGS. 6 and 7, the drilling process that was described in FIGS. 4 and 5, i.e., the placement of the upstock 30, within the upper coal seam 12, is now being done for the lower coal or shale seam 14, and the process as described in FIG. 5 is showing being repeated for the lower coal seam 14 in FIG. 7. Therefore, there is no need to repeat this process as it is repeated for the second and lower coal or shale seam 14. However, it should be noted that during the process as described above, water is being collected within sump portion 50 below the lower seam 14, and removal of this water, referred to as a dewatering process will be described further.

Figure 8:
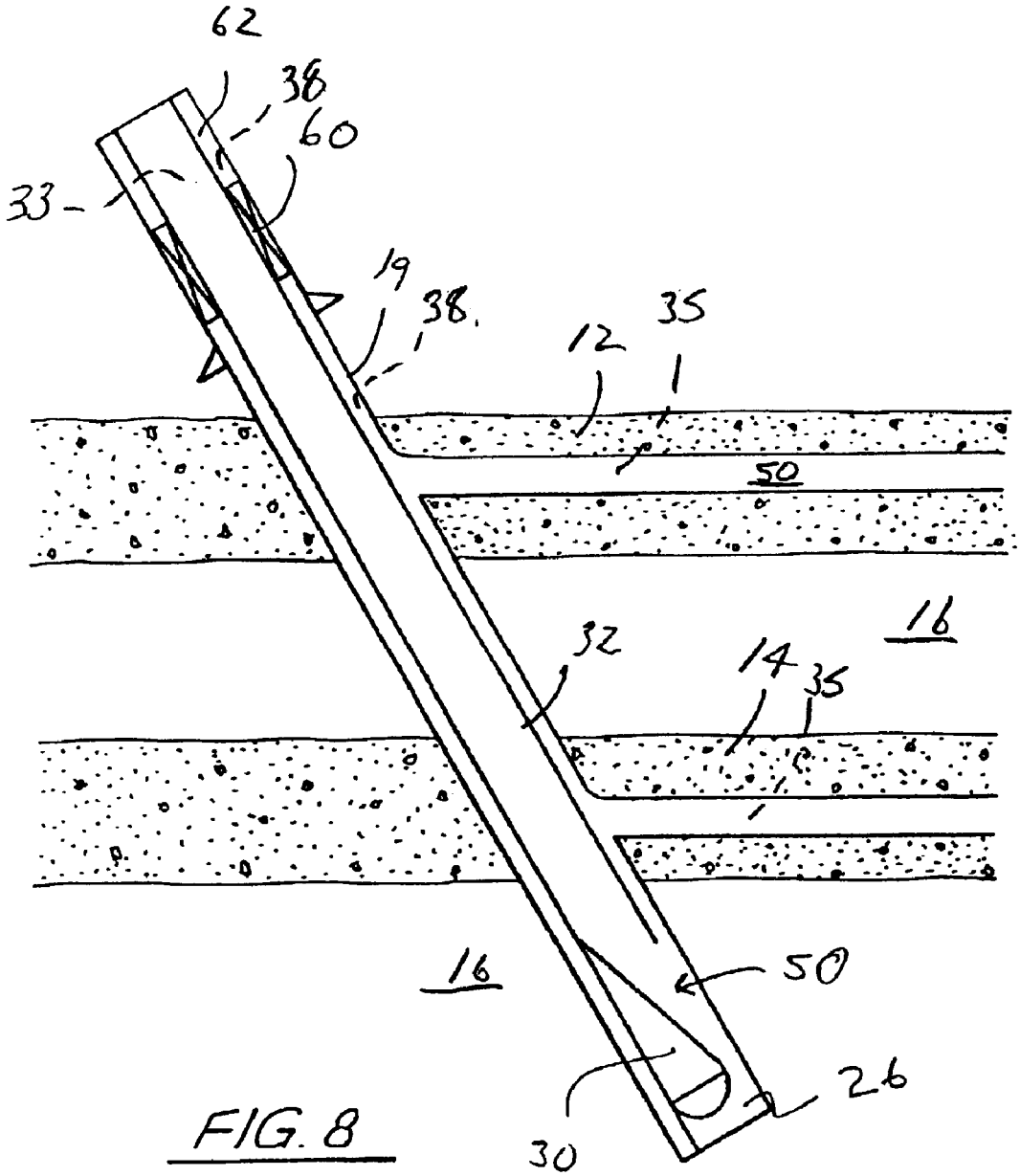
FIG. 8 illustrates lowering the upstock to the bottom of the sump and setting the packer for completing the well.

Turning now to FIG. 8, upon completion of the underbalanced drilling of the upper coal seam and lower coal seam 12 and 14, the upstock 30 is then lowered to the bottom 26 of the well bore 18. The well bore as seen in FIG. 8 has been drilled to a deeper depth than the lowest coal seam 14, thus creating a sump 50 in the well bore. At a spaced distance above the upstock 30 in the carrier string 34, a packer 60 has been placed. This packer 60 can be a mechanical type packer such as a Baker 2XP or an inflatable packer such as those manufactured by Tam International. The packer 60 is then set creating a seal in the annulus 38 between the carrier string 32 and the outer casing 23. This will, in effect, isolate the annulus 38 above and below the packer 60 between the carrier string 32 and the outer casing 23.

Figure 9:
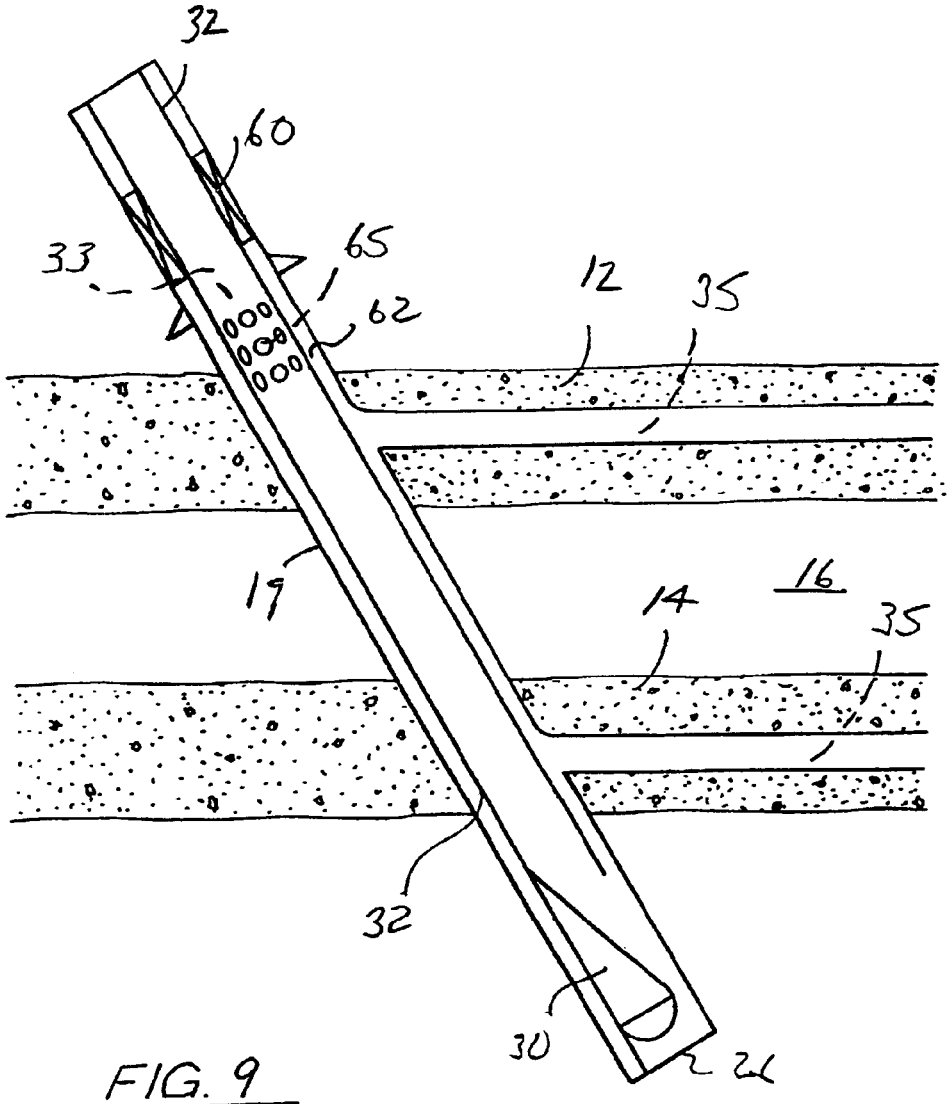
FIG. 9 illustrates perforating the carrier string below the packer.

As seen in FIG. 9, there is illustrated a plurality of perforations 65 which have formed in the wall of the carrier string 32 through the use of a perforating gun, the type that is commonly know in the oil and gas industry. The gun would have been lowered into the carrier string 32, to a point below the packer 60, which would, when fire, create the perforations 65 for which gas may enter the carrier string annulus 33.

Figure 10:
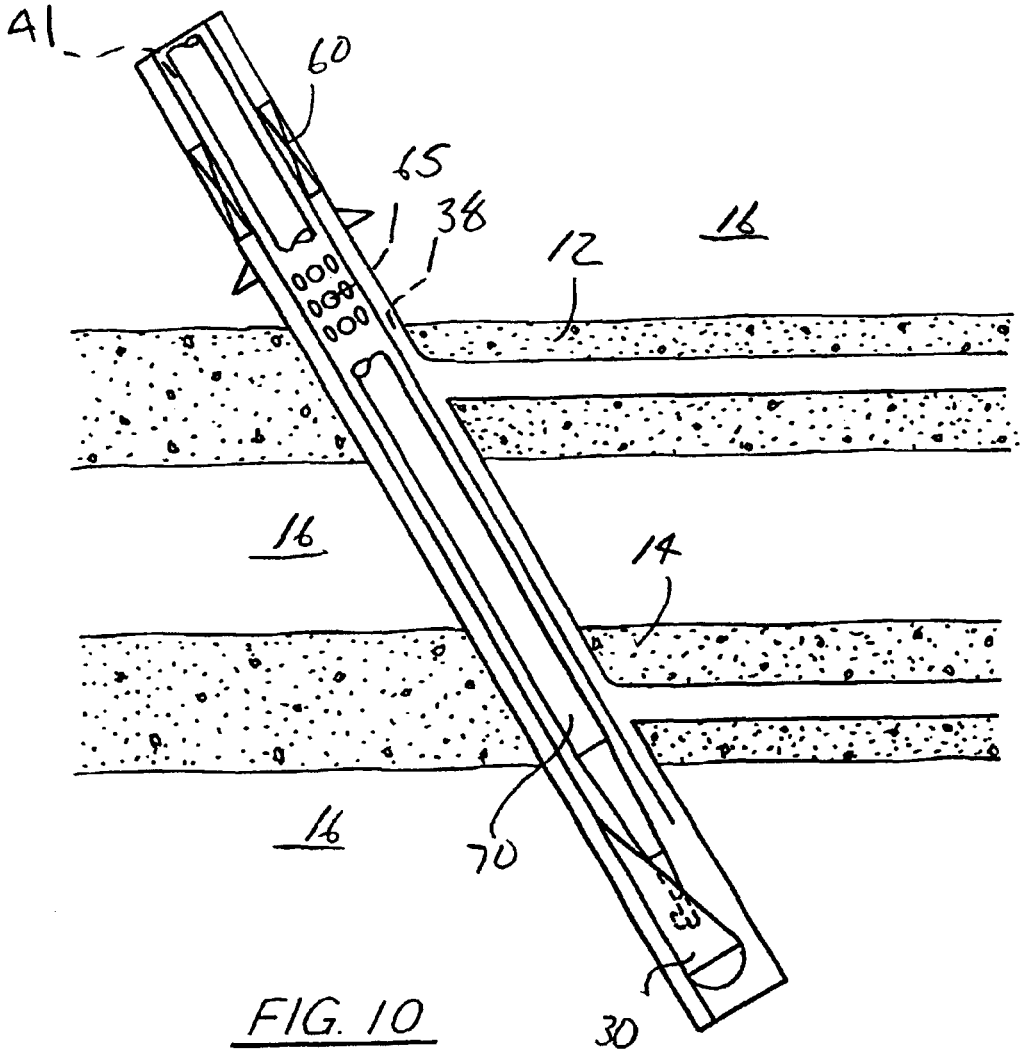
FIG. 10 illustrates lowering the ramp retrieving tool.
Figure 11:
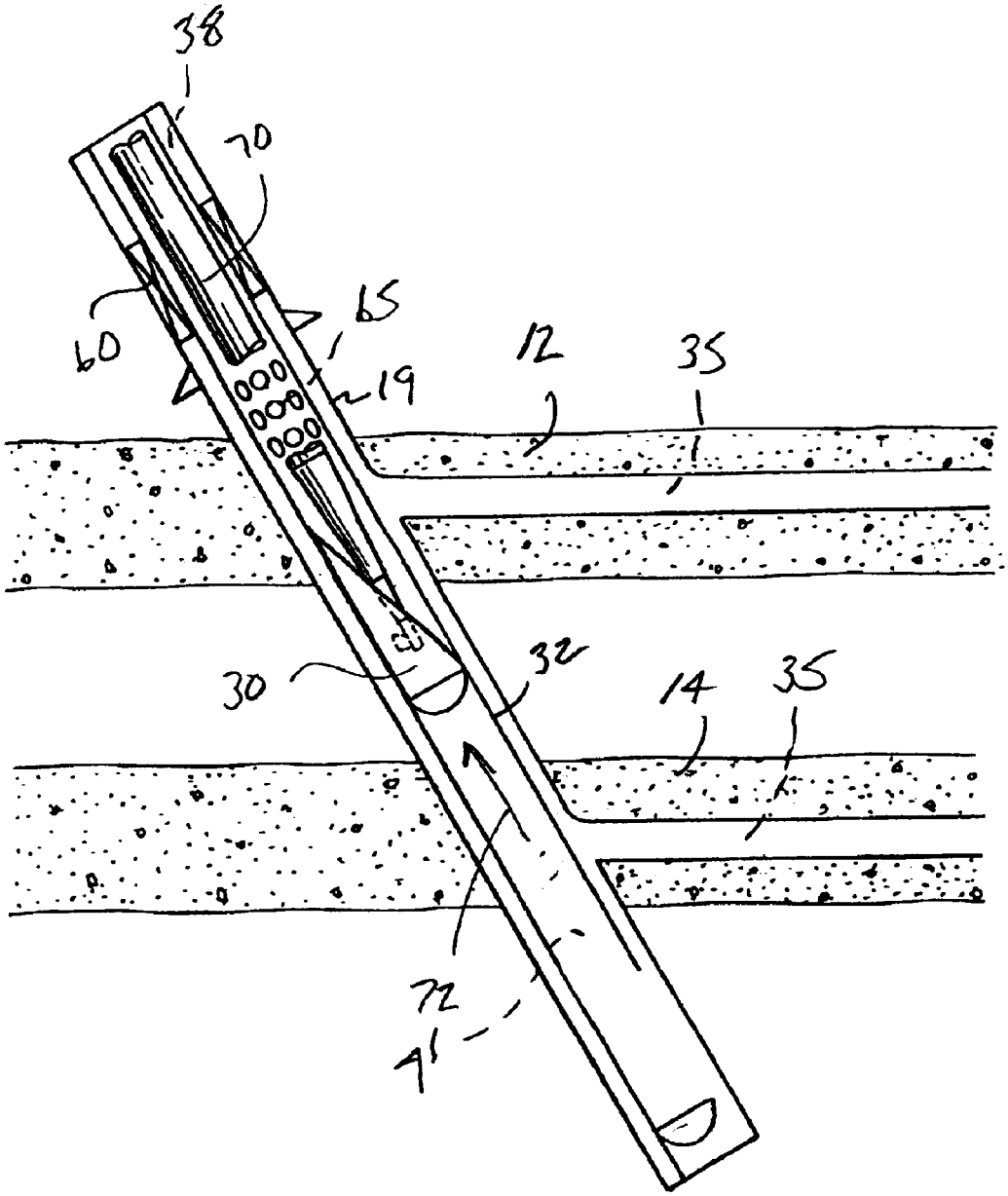
FIG. 11 illustrates pulling out the ramp.
Figure 12:
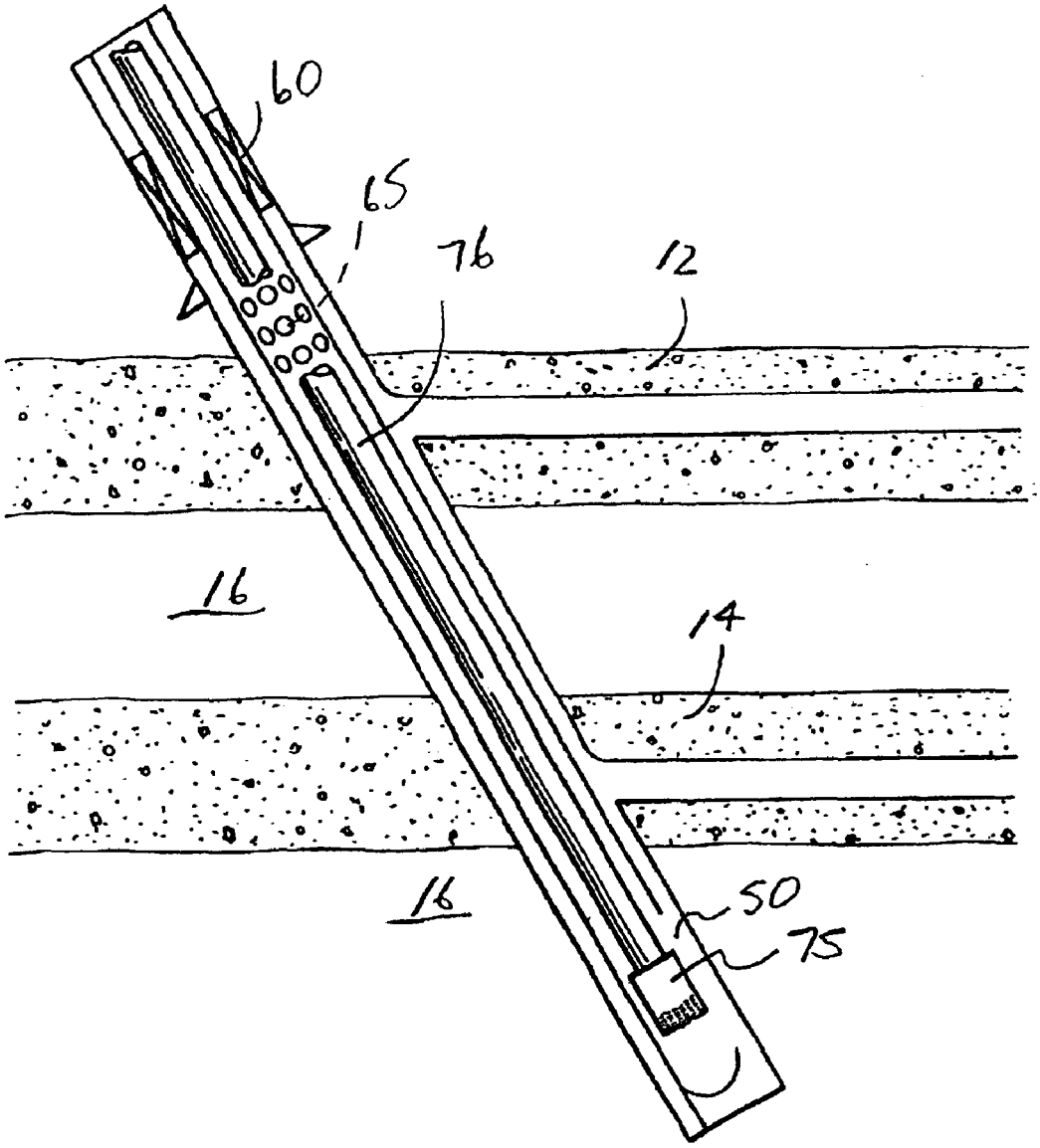
FIG. 12 illustrates Running ESP and tubing in the well to conclude the completion phase.

As illustrated in FIGS. 10 through 12, there is illustrated a ramp retrieving tool 70, which would be utilized to retrieve the upstock 30 from the borehole 18, as illustrated in FIG. 11 by arrows 72. Next, an electrical submersible pump (ESP) 75, of the type which is known in the industry, and manufactured by Weatherford, is then lowered at the end of tubing 76, which has been lowered into the carrier string 32, which has the perforations 65 in its wall as was described earlier in relation to FIGS. 9 and 10. After the ESP 75 is set in place below the water level in the sump portion 50 within the borehole 18, as seen in FIG. 12, the water 85 within the system that flows downward into the sump portion 50 of the well, will be pumped from the sump portion 50 in a dewatering process while the gas production process proceeds, as will be described further.

Figure 13:
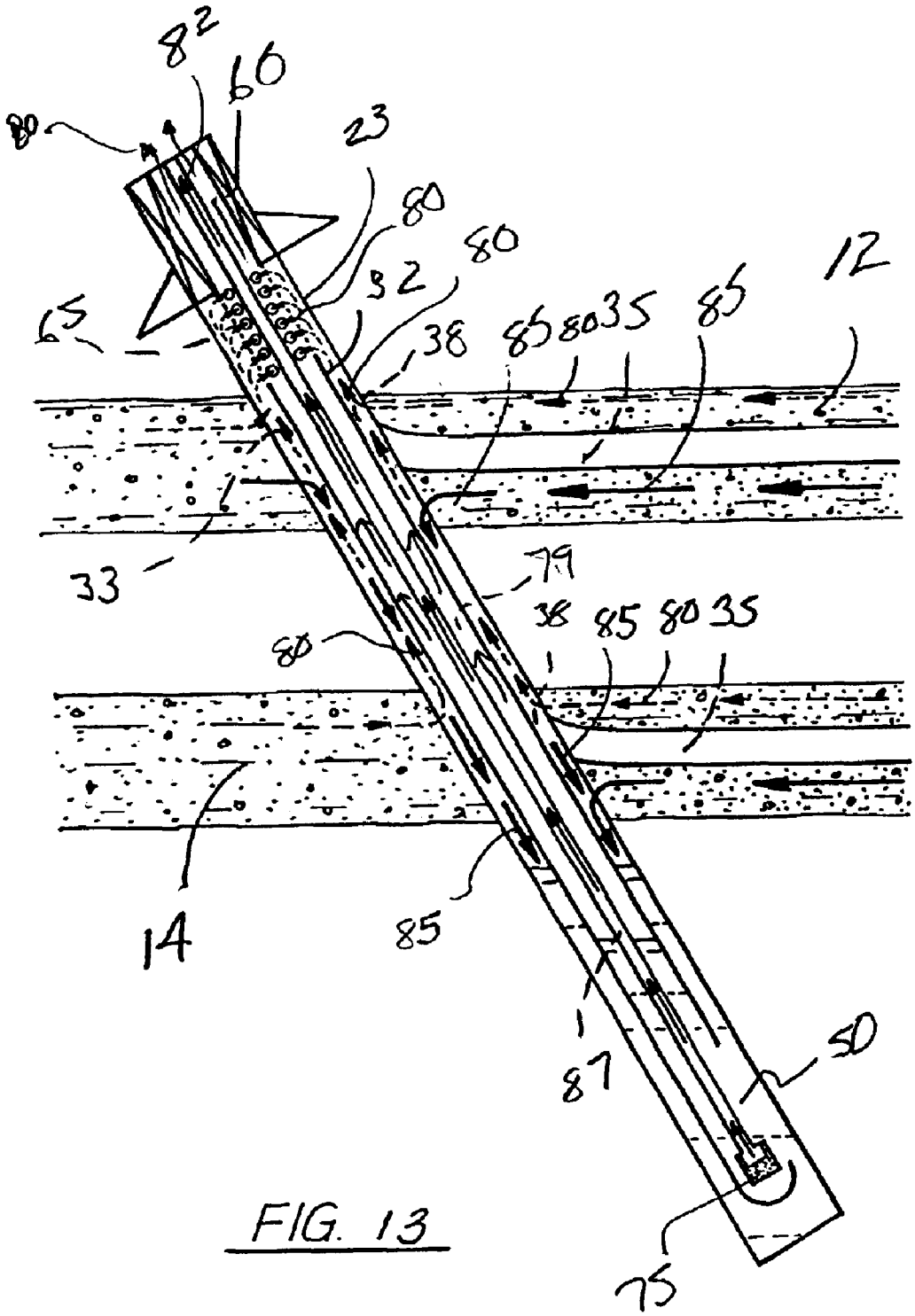
FIG. 13 illustrates the gas production and dewatering phase of the process.

Turning to FIG. 13, the gas (arrows 80) from the two coal seams 12 and 14 will flow through lateral bores 35 into outer annulus 38 between the carrier string 32 and the open hole wall 19 or casing 19A, and encountering the packer 60, will enter the perforations 65 of the carrier string 32 and will be retrieved up the annulus 33 of the carrier string 32 between the inner wall of the tubing 76 and the wall of the carrier string 32. Meanwhile, the water (arrows 85) flowing from the coal seams 12, 14 would flow down into the sump portion 50, and would pumped by the ESP 75 up the inner bore 87 of the string 76 up to the surface to be injected down 85 to injection zones 90, 100, either above or below the two coal seams 12, 14.

Figure 14:
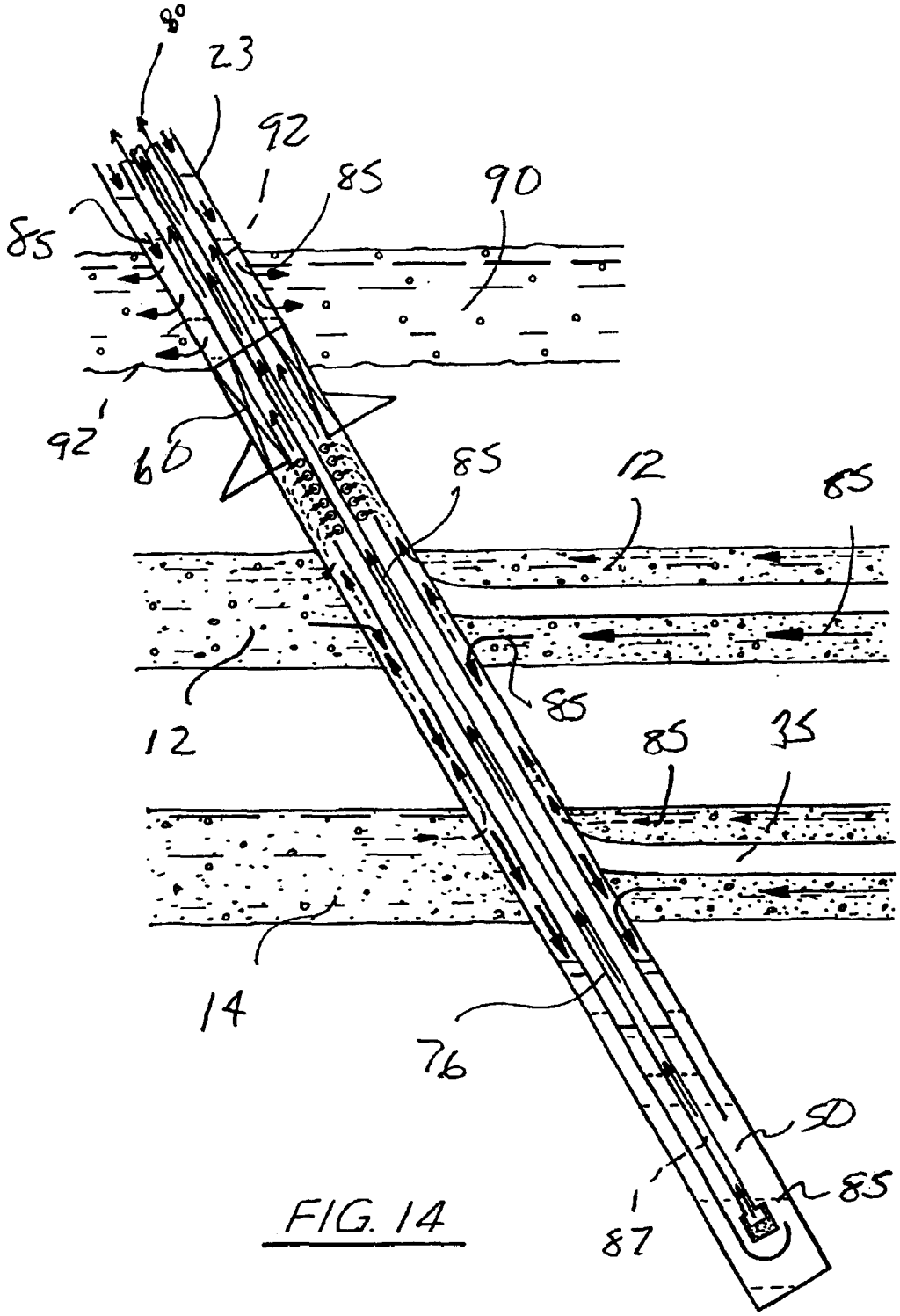
FIG. 14 illustrates further gas production and dewatering phase (option 1)

As seen in FIG. 14, there is represented the first option of the produced water disposal process. In this option, the water 85 in sump 50 would be pumped up the inner bore 87 of string 76, to surface, and then be returned to the upper water injection zone 90 above the upper coal seam 12. The water upon reaching the surface would be routed back down the annulus 38 between the casing 23 and the carrier string 32. At the point above the packer 60, perforations in the casing 23 would allow the water to enter the water injection zone 90 for produced water disposal. This is known as the produced water disposal process.

Figure 15:
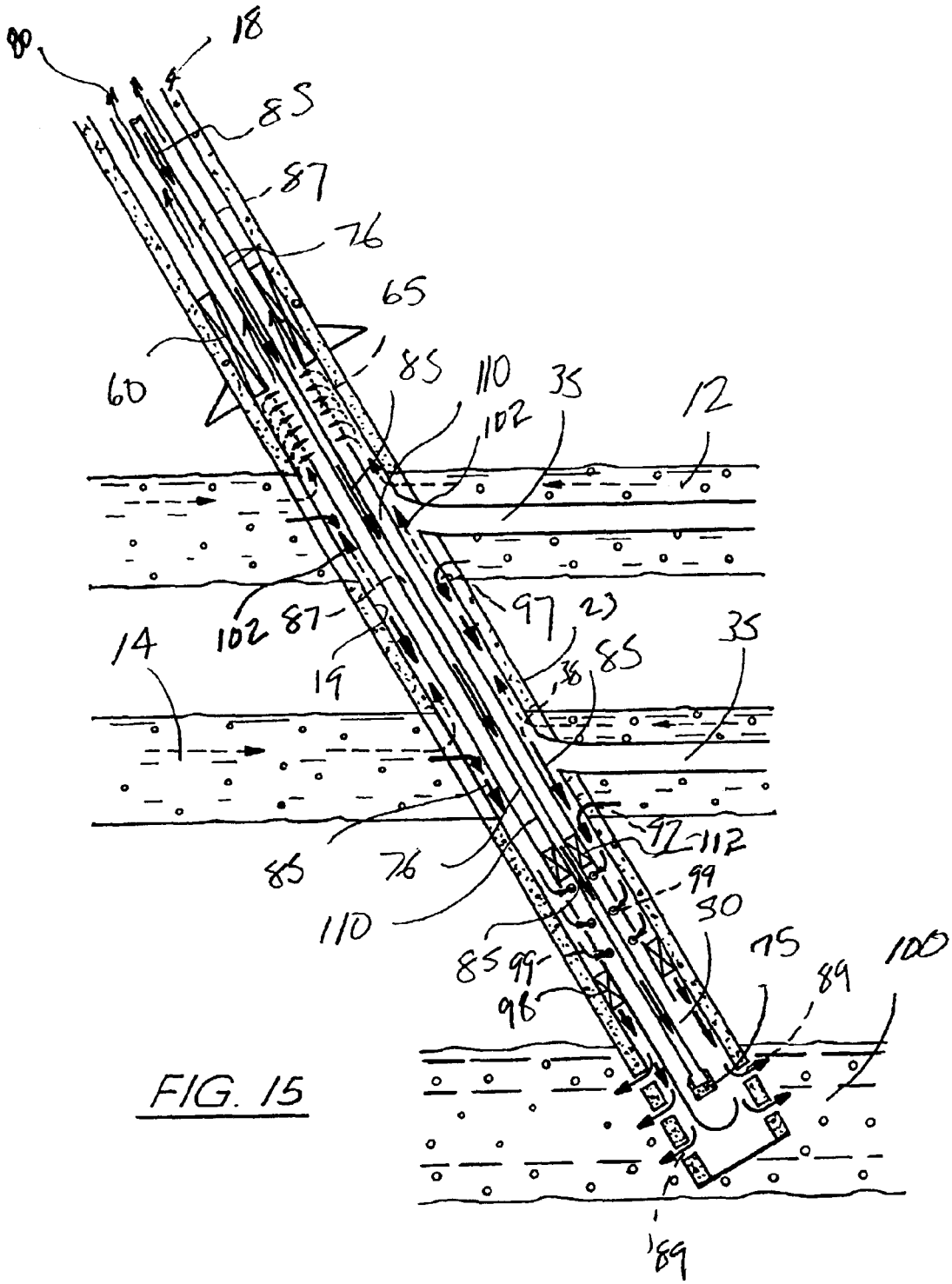
FIG. 15 illustrates gas production and dewatering phase (option 2)

FIG. 15 illustrates a second option in the water disposal process. The borehole illustrated in FIG. 15 will be designated borehole 95, since it will function to undertake the process as described for boreholes 18 and 35, but additionally, will collect water 85 from other related boreholes 18 and 35 in the system, as seen by arrows 91 in FIG. 16.

Figure 16:
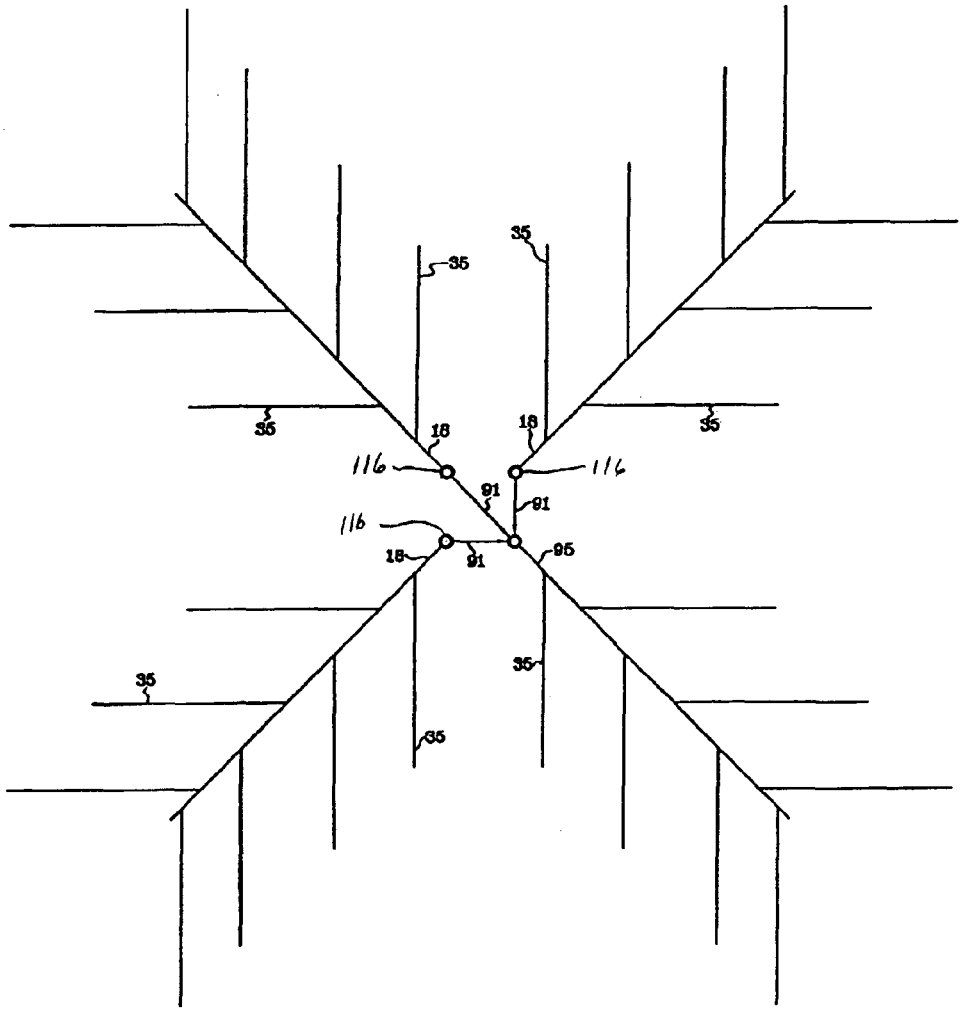
FIGS. 16–16B illustrates a schematic of multiple wells drilled in the process of the present invention.
Figure 16A:
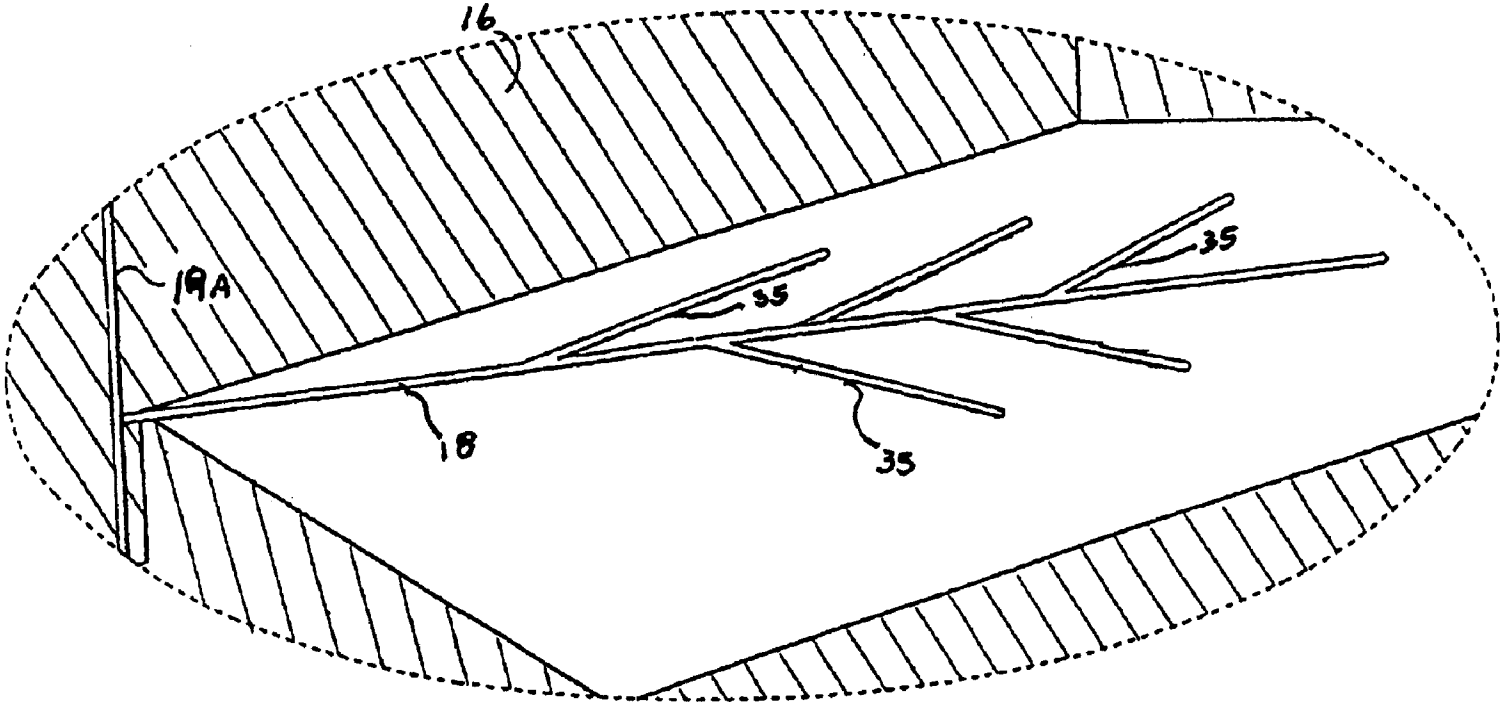

In FIG. 16, there is illustrated a schematic of multiple boreholes 18, with lateral bores 35 extending from each borehole 18, from main borehole 19 or 19A and in theory each lateral bore 35 retrieving gas and water. In this option rather than each well system being an individual injector well, three of the boreholes 116 would utilize an ESP 75 to bring the water to the surface, as described in relation to FIG. 14. However, rather than return the water to a water injection zone 90 within that individual borehole 116, the water would be pumped via lines 91 to the single borehole 95, where the water 85 would be returned downhole to the ESP 75 in borehole 95, as illustrated in FIG. 15.

Figure 17:
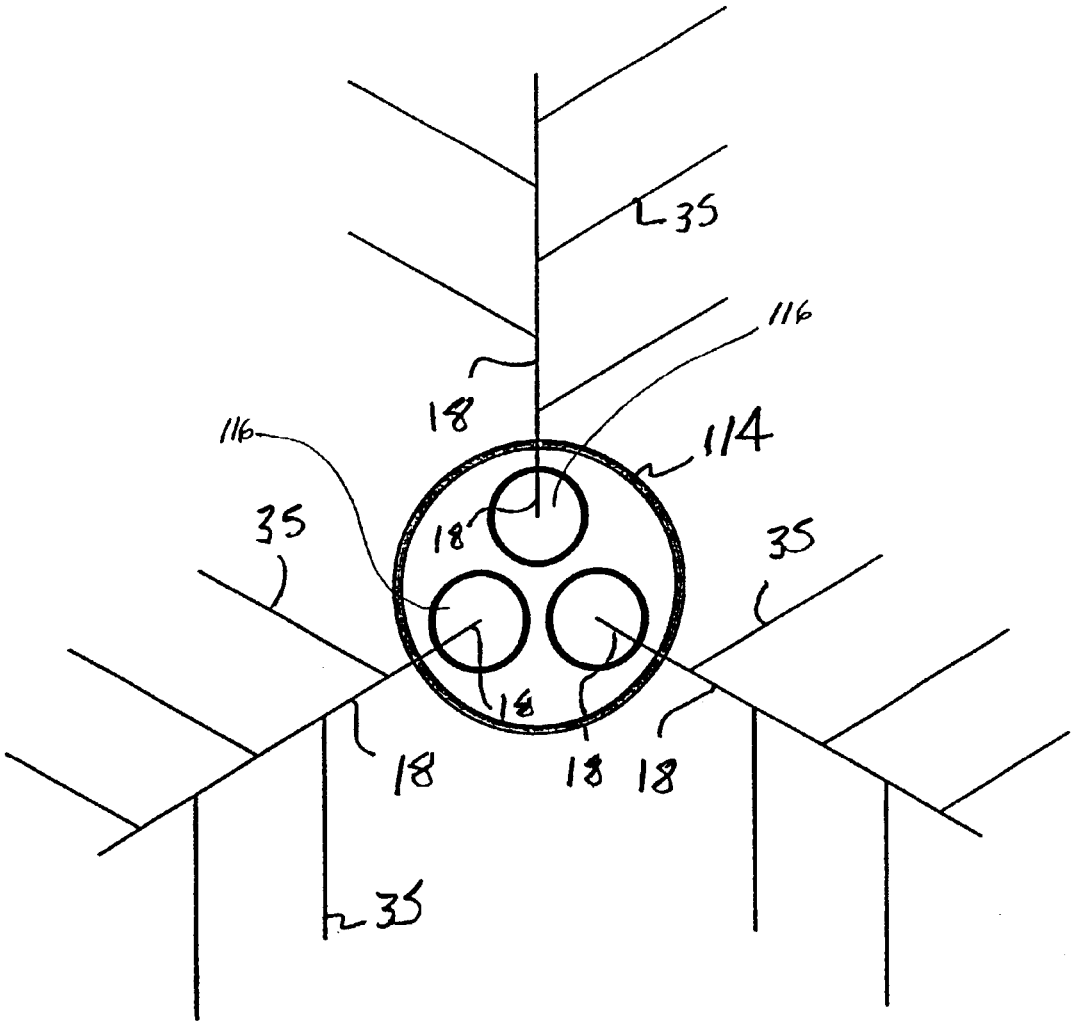
Figure 18:
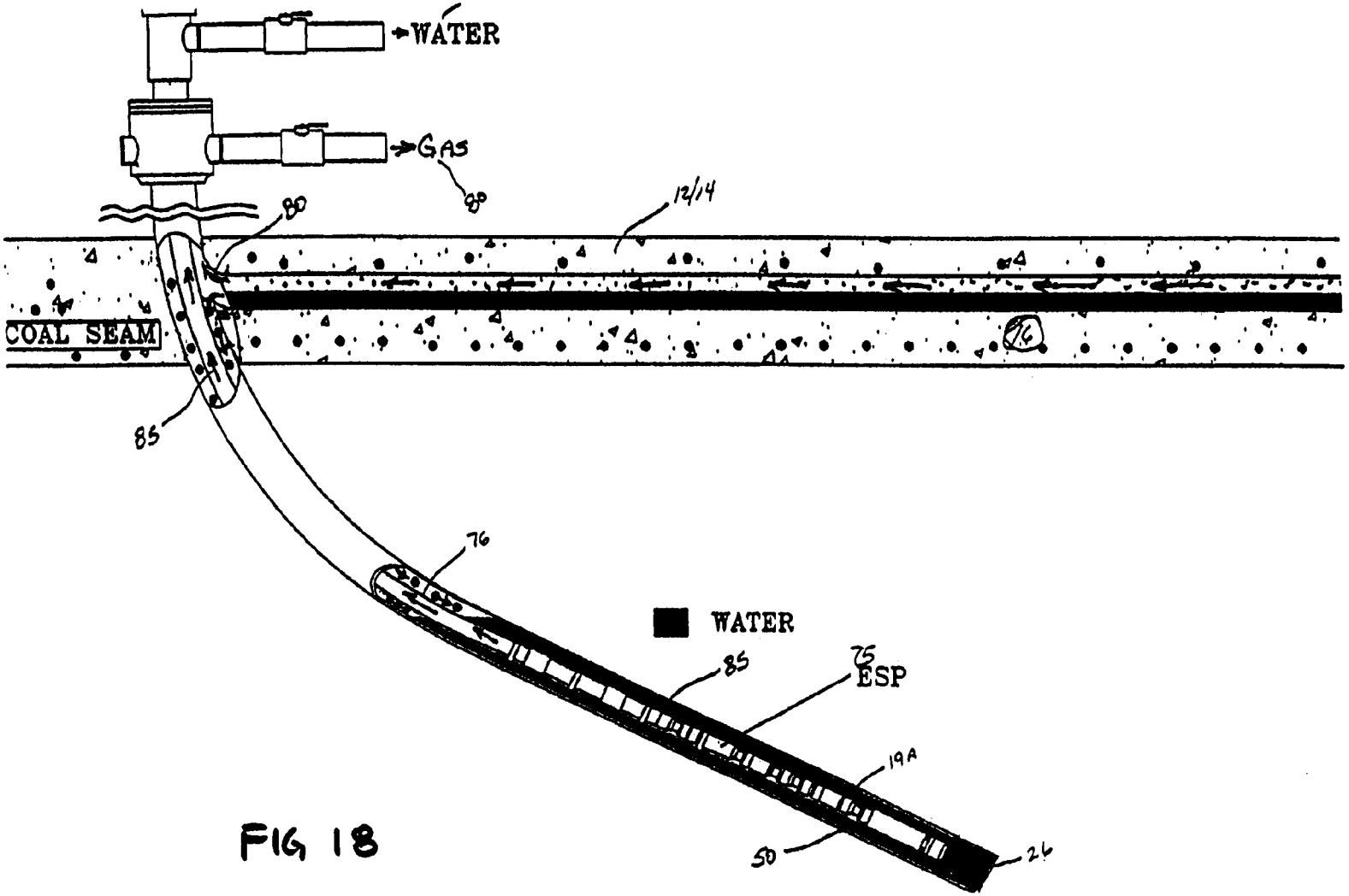
FIG. 18 illustrates the process of collecting the methane gas from the coal/shale formation into an annulus between the case primary borehole and the tubing string.

In FIGS. 17, 17A and 18 there is illustrated a schematic of the wells or boreholes 18 in FIG. 16, but for the fact that the multiple wells 18, a total of three as seen in FIG. 17, are brought to the surface, and are encased in a single caisson 114, so that the three wells can be together at the well head on the surface.

Now turning to FIG. 15, the water 85, collected from the surface and other boreholes 18, would travel down the inner bore 87 of string 76 to enter the second or lower water collection zone 100 below the lower coal seam 14, at the sump area 50. As is seen, a gas collection zone 110 within the carrier string 32 has been isolated from the water via a second packer 87 between the wall of the carrier string 32 and the inner string 76, to isolate the gas production zone 110 within the carrier string 32 from the sump 50 containing the water 85. The methane gas (arrows 102) would travel from the lateral wells 35, into annulus 38, and then enter perforations 65 in the carrier string 32 to travel to the surface for collection.

In the dewatering process, when the water enters the borehole 95, from the other boreholes 18, the water 85 will travel down the inner bore 87 of string 76 into the water sump 50, while water 85 is also being collected from the coal formations 12, 14 in borehole 95, through perforations 97 in the wall 19 of the casing 23, to travel down the annulus 38 between the carrier string 32 and casing 23, into the sump 50. At the level above the ESP 75, a third packer 98 has been placed in the annulus between the carrier string 32 and the casing 23, so as to isolate the sump 50. Therefore, the water traveling down the annulus 38 will flow through perforations 99 formed in the wall of the carrier string below the packer 98, so that the ESP 75 can pump the collected water 85 into the lower water injection zone 100 through perforations 89 formed in the wall of the casing 23. Likewise, the water 85 traveling down the annulus 87 of string 76 will be pumped by the ESP 75 through the perforations 89. This process will allow the water to flow into the lower water injection zone 100 in borehole 95, thus having a single well 95 collecting the water 85 from multiple wells, through the inner string 76, and water from the borehole 95 being collected as described above. Therefore, the dewatering and disposal process is simplified, since the water 85 from all wells is be injected in a single collection zone 100 in well 95, while the methane gas is collected within the annulus.

| Parts List: | |
|---|---|
| upper coal seam | 12 |
| lower coal seam | 14 |
| formation | 16 |
| borehole | 18 |
| wall | 19 |
| casing | 19A |
| drill string | 20 |
| drill bit | 22 |
| casing | 23 |
| drill motor | 24 |
| bottom depth | 26 |
| arrow | 21 |
| upstock | 30 |
| ramp portion | 31 |
| carrier string | 32 |
| annulus | 33 |
| drill string | 34 |
| lateral bore | 35 |
| arrow | 37 |
| annulus | 38 |
| fluid | 39 |
| mud motor | 40 |
| inner annulus | 41 |
| arrow | 43 |
| annulus | 45 |
| sump portion | 50 |
| annulus | 51 |
| packer | 60 |
| perforations | 65 |
| retrieving tool | 70 |
| arrows | 72 |
| electrical submersible pump | 75 |
| tubing | 76 |
| gas | 80 |
| lines | 82 |
| water | 85 |
| inner bore | 87 |
| water collection zone | 90 |
| lines | 91 |
| perforations | 92 |
| borehole | 95 |
| perforations | 97 |
| packer | 98 |
| perforations | 99 |
| water collection zone | 100 |
| methane gas | 102 |
| perforations | 105 |
| gas collection zone | 110 |
| packer | 112 |
| cement | 113 |
| single caisson | 114 |
| drilling rig | 115 |
| well system | 116 |

What is claimed is:

1. A process for productions of methane and shale gas from coal and shale formations utilizing underbalanced multilateral drilling, comprising the following steps:

a. drilling a first borehole into a coal/shale formation;

b. lowering a carrier string w/deflection member down the first borehole to the level of the coal/shale formations;

c. lowering a drill string into the carrier string to drill a lateral borehole off of the first borehole into the coal/shale formations;

d. introducing nitrogen/air/water down the annulus between the first borehole and the carrier string;

e. pumping nitrogen/air/drilling fluid down the drill string annulus;

f. returning nitrogen/air/drilling fluid/methane gas from the lateral borehole into the annulus between the drill string and carrier string, to surface.

2. The process of claim 1, wherein the first borehole is drilled to a depth below the formation for defining a sump portion of the borehole.

3. The process of claim 1, further comprising the step of collecting water from the coal/shale formation during the dewatering and depressurizing process.

4. The process in claim 1, further comprising the step of lowering an artificial lift system down into the sump portion at the end of a tubing string for pumping water collected in the sump portion to the surface.

5. The process in claim 4, wherein the artificial lift system would be selected from a group of systems including ESP, beam pump, progressive cavity, or jet system.

6. The process in claim 1, wherein the collected methane gas is collected into the annulus between the tubing string and the carrier string through a plurality of perforations in the wall of the carrier string.

7. The process in claim 1, wherein the produced water in the borehole is returned to a water injection zone in at least a single well.

8. In an underbalanced drilling process for drilling into coal and shale formations, where there is provided a cased primary borehole housing a carrier string, where a drill string has provided a lateral borehole or boreholes from the cased borehole into the coal/shale formation, a process for eliminating permeability damage to the coal or shale during the underbalanced drilling process, comprising the following steps:

a. drilling the primary borehole through the coal/shale formation to a depth below the formation to define a sump portion of the borehole;

b. collecting water from the coal/shale formation during the dewatering and depressurizing process;

c. lowering an artificial lift system down into the sump portion at the end of a tubing string;

d. pumping water collected in the sump portion to the surface through a bore in the tubing string;

e. collecting the methane gas from the coal/shale formation into the annulus between the casing and the carrier string;

f. flowing the collected methane gas into the carrier string through perforations in the wall of the carrier string to the surface;

g. returning the water to a water injection zone in at least a single well;

h. collecting the methane gas from the coal/shale formation into an annulus between the case primary borehole and the tubing string.

9. The process in claim 7, wherein a carrier string is lowered down the first borehole to a level of the coal/shale formation.

10. The process in claim 7, further comprising the step of lowering a drilling string into the carrier string to drill a lateral borehole off of the first borehole into the coal/shale formation.

11. The process in claim 7, further comprising the step of introducing nitrogen/air/water down the annulus between the first borehole and the carrier string.

12. A process for underbalanced drilling into coal and shale formations to produce methane and shale gas, and dewatering the drilled formation, comprising the following steps:

a. drilling a first borehole through a coal/shale formation to a depth below the coal/shale formation to define a sump portion of the borehole;

b. lowering a carrier string down the first borehole to the level of the coal/shale formation;

c. lowering a drill string into the carrier string to drill a lateral borehole off of the first borehole into the coal/shale formation;

d. introducing nitrogen/air/water down the annulus between the first borehole and the carrier string;

e. pumping nitrogen/air/drilling fluid down the drill string annulus;

f. returning nitrogen/air/drilling fluid/methane gas from the lateral borehole into the annulus between the drill string and carrier string, to surface;

g. collecting water in the sump portion from the coal/shale formation during the underbalanced drilling process;

h. lowering a fluid pumping system down into the sump portion at the end of a tubing string;

I. pumping water collected in the sump portion to the surface through a bore in the tubing string;

j. collecting the methane gas from the coal/shale formation into the annulus between the casing and the carrier string;

k. flowing the collected methane gas into the carrier string through perforations in the wall of the carrier string to the surface; and l. returning the water down the borehole to be injected into a water injection zone in the formation.

13. The process in claim 11, wherein there is provided a plurality of multiple boreholes and the water which is brought to the surface from the three boreholes is returned down a single borehole.

14. The process in claim 11, wherein the multiple wells are encased in a single caisson so that the three wells can be grouped at the wellhead on the surface.

15. The process in claim 12, further comprising the step of drilling multilateral wells from the lateral borehole off of the first borehole in order to carry out the process in each of the multilateral extension boreholes.

* * * * *